US006073925A

United States Patent [19]

Sato

[11] Patent Number: 6,073,925

[45] Date of Patent: Jun. 13, 2000

[54] IMAGE FORMING APPARATUS

[75] Inventor: Mitsuo Sato, Shibata-machi, Japan

[73] Assignee: Tohoku Ricoh Co., Ltd., Shibata-gun, Japan

[21] Appl. No.: 08/796,696

[22] Filed: Mar. 4, 1997

[30] Foreign Application Priority Data

Apr. 17, 1996 [JP] Japan ..... 8-095192
Jan. 14, 1997 [JP] Japan ..... 9-004586

[51] Int. Cl.[7] ..... B65H 1/00

[52] U.S. Cl. ..... 271/171; 271/223; 271/224

[58] Field of Search ..... 271/171, 223, 271/224

[56] References Cited

U.S. PATENT DOCUMENTS

| | | | |
|---|---|---|---|
| 4,346,882 | 8/1982 | Pessina et al. | 271/223 X |
| 4,864,368 | 9/1989 | Muramatsu | 271/171 X |
| 5,110,106 | 5/1992 | Matsumura et al. | 271/171 X |
| 5,689,759 | 11/1997 | Isemura et al. | 271/265.02 X |
| 5,690,030 | 11/1997 | Greive | 271/223 X |

FOREIGN PATENT DOCUMENTS

| | | | |
|---|---|---|---|
| 0212332 | 12/1984 | Japan | 271/171 |
| 60-220752 | 11/1985 | Japan . | |
| 60-220753 | 11/1985 | Japan . | |
| 3-30370 | 6/1991 | Japan . | |
| 404045037 | 2/1992 | Japan | 271/171 |
| 406048588 | 2/1994 | Japan | 271/171 |
| 406056284 | 3/1994 | Japan | 271/223 |
| 6-345281 | 12/1994 | Japan . | |
| 8-91710 | 4/1996 | Japan . | |

*Primary Examiner*—Robert P. Olszewski
*Assistant Examiner*—Steven B. McAllister
*Attorney, Agent, or Firm*—Oblon, Spivak, McClelland, Maier & Neustadt, P.C.

[57] ABSTRACT

A pair of paper delivery side fences is provided within a paper delivery unit so as to approach each other and move away from each other. A drive unit drives the pair of paper delivery side fences so as to change an opposite interval defined therebetween. At this time, the size of a sheet of transfer paper discharged to the paper delivery unit is recognized and the interval defined between the pair of paper delivery side fences is set to an interval corresponding to the size of the transfer paper. Thus, the interval defined between the opposed paper delivery side fences can be automatically set according to the size of the transfer paper delivered to the paper delivery unit and hence workability can be improved.

4 Claims, 12 Drawing Sheets

IMAGE FORMING APPARATUS

BACKGROUND OF THE INVENTION

1. Field of the Invention

This invention relates to an image forming apparatus for forming a desired image on a sheet of transfer paper delivered from a paper feeding unit to a paper delivery unit, and particularly to an image forming apparatus having a structure in which paper delivery side fences are provided within a paper delivery unit.

2. Description of the Earlier Technology

A printer, a copier and the like have heretofore been put into practical use as an image forming apparatus for allowing a sheet of transfer paper to pass through a paper-passage route extending from a paper supply or feeding unit to a paper delivery unit and forming a desired image on the transfer paper during the process of above paper passage. For example, a stencil printer that falls under the category of a printer, has a structure wherein a master composed of a thermoplastic resin is perforated under heating to form a desired perforated image thereon and ink is transferred to a sheet of transfer paper through perforations defined in the master to thereby form an image. Further, the copier has a structure wherein an electrostatic latent image is formed over a uniformly-charged photosensitive body and subjected to development by toner or the like, followed by transfer to transfer paper, and the transferred developed image is subjected to fixing to thereby form an image. In either case, the image forming apparatus has one thing in common in that the transfer paper is allowed to pass through the paper-passage route extending from the paper feeding unit to the paper delivery unit and the desired image is formed on the transfer paper during the process of the paper passage. In general, sheets of transfer paper piled and placed on a paper feeding unit are separated and supplied therefrom so as to be delivered to a paper-passage route.

In this type of image forming apparatus, the size of transfer paper capable of forming an image thereon is generally diversified into various forms as the image forming apparatus changes into a large model. Therefore, a model capable of forming images on transfer paper of various different sizes normally has a structure in which a pair of opposed side fences are provided at a paper feeding unit with the transfer paper piled and placed thereon, and the interval defined between the opposed side fences is variable. In the model having such a structure, a skew intended to be produced in each separated and supplied transfer paper can be avoided by adjusting the interval between the opposed side fences according to the size of the transfer paper.

In the image forming apparatus capable of forming the images on the transfer paper of various sizes, side fences, which are able to approach each other and move away from each other in a paper-width direction, are generally provided even at a paper delivery unit and the discharged transfer paper can be jogged. FIG. 1 is a plan view showing one example of a conventional paper delivery unit. A pair of side fences 103 is provided within a paper delivery tray 102 of a paper delivery unit 101 so as to be slidable in the transverse direction of unillustrated transfer paper (i.e., in the direction indicated by arrow a in FIG. 1) along a guide rail 104. Further, an end fence 106 is also attached to the paper delivery tray 102 so as to be slidable along a guide rail 105. Moreover, an end fence 107 corresponding to transfer paper of small sizes is also attached to the paper delivery tray 102 so as to be slidable along a guide rail 108. The end fence 107 is able to rise and fall so as to keep out of the way of transfer paper of large sizes upon delivery of the large-sized transfer paper. The directions in which the two end fences 106 and 107 slide, correspond to paper delivery forward and reverse directions of the transfer paper (i.e., the directions indicated by arrows b in FIG. 1).

SUMMARY OF THE INVENTION

Problems of such an earlier technology will next be described. In general, an operator must manually adjust the positions of the side fences and the end fence even at the paper feeding unit and the paper delivery unit. As the work at this time, for example, the positions of the side fences and the end fence are adjusted in accordance with the scales. Therefore, a problem arises in that the work becomes cumbersome. Particularly, the paper delivery unit 101 shown in FIG. 1 by way of example needs a selecting process as to which one of the end fences 106 and 107 should be used and a process for making the small-sized end fence 107 rising and falling, the work is much more troublesome and cumbersome.

Further, a problem arises in that since the adjustments to the positions of the side fences and the like depend on the manual operation, they are apt to be misaligned at all times and hence this will cause a paper jam and a disturbance in paper jogger.

Moreover, a problem arises in that the interval between the opposed side fences on the paper feeding unit side and the interval between the opposed side fences on the paper delivery unit side must be adjusted independently in isolation, whereas the operator is apt to forget the work of adjusting the positions of the side fences and the end fence on the paper delivery unit side as the natural mentality of the operator.

With the foregoing in view, it is an object of the present invention to provide an image forming apparatus capable of eliminating the need for a process of adjusting the interval between paper delivery side fences or the position of a paper delivery end fence and greatly improving workability therefor.

It is another object of the present invention to provide an image forming apparatus capable of accurately adjusting the interval between paper delivery side fences or the position of a paper delivery end fence and preventing a paper jam and a disturbance in paper jogger.

It is a further object of the present invention to provide an image forming apparatus capable of allowing paper delivery side fences or a paper delivery end fence to perform a jogger operation in timing provided to discharge or deliver transfer paper to a paper delivery unit and of making an improvement in jogging quality of the transfer paper at the paper delivery unit.

It is a still further object of the present invention to provide an image forming apparatus capable of eliminating the need for a special power translation mechanism for a jogger operation of a paper delivery side fence pair or a paper delivery end fence, simplifying its structure and facilitating its control.

It is a still further object of the present invention to provide an image forming apparatus capable of easily taking out discharged transfer paper.

It is a still further object of the present invention to provide an image forming apparatus capable of preventing transfer paper discharged to a paper delivery unit and not yet eliminated, from becoming damaged.

It is a still further object of the present invention to provide an image forming apparatus capable of facilitating the manual work of paper delivery side fences or a paper delivery end fence.

It is a still further object of the present invention to provide an image forming apparatus capable of reproducing the positions of paper delivery side fences or the position of a paper delivery end fence, both being set on a discrete basis.

According to one aspect of the present invention, for achieving the above objects, there is provided an image forming apparatus for allowing sheets of transfer paper to pass through a paper-passage route extending from a paper feeding unit for accommodating the transfer paper therein to a paper delivery unit for discharging the transfer paper therefrom, and forming a desired image on each transfer paper during the process of the paper passage, comprising:

paper size recognizing means for recognizing the size of the transfer paper delivered to the paper delivery unit;

a pair of paper delivery side fences provided within the paper delivery unit least one of which is slidable in the transverse direction of the transfer paper;

a drive unit for driving the paper delivery side fences which are slidable in the paper-width direction; and setting means for starting up the drive unit so as to set an interval between the paper delivery side fences to an interval corresponding to the size of the transfer paper, which has been recognized by the paper size recognizing means. Thus, the paper size recognizing means recognizes the size of the transfer paper delivered or discharged to the paper delivery unit. Further, the interval between the opposed paper delivery side fences is automatically set to the interval corresponding to the recognized size of transfer paper. As a result, the work of manual adjustments to the paper delivery side fences becomes unnecessary.

BRIEF DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

DETAILED DESCRIPTION OF THE PREFERRED EMBODIMENTS

1. Summary of Preferred Embodiments

Figure 1:
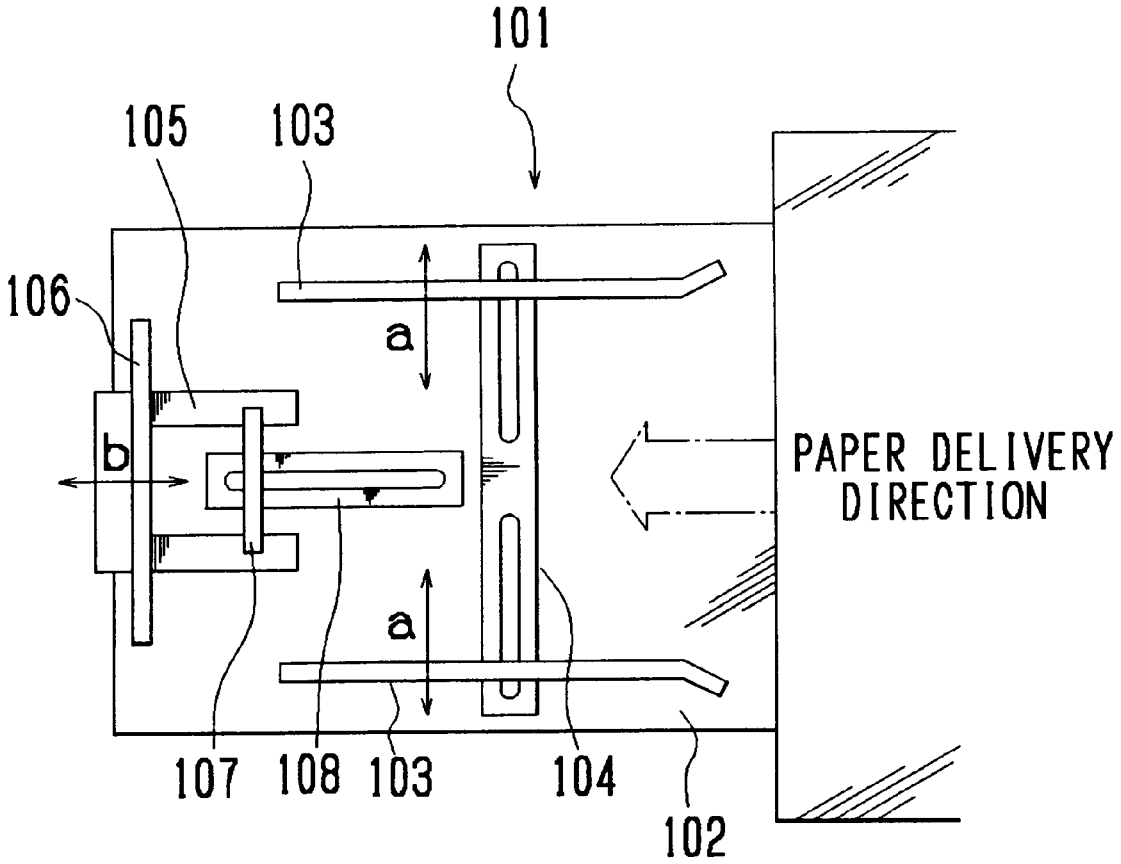
Fig. 1 PRIOR ART
FIG. 1 is a plan view showing one example of a conventional paper delivery table.

Preferred embodiments will be predicated on an image forming apparatus for allowing transfer paper to pass through a paper-passage route extending from a paper supply or feeding, unit to a paper delivery unit and forming a desired image on the transfer paper during its paper passage process. The image forming apparatus comprises a recognizing means for recognizing the size of transfer paper delivered to the paper delivery unit, a pair of paper delivery side fences provided in the paper delivery unit and whose at least one is slidable in the direction of the width of the paper, a drive unit for driving the paper delivery side fences so as to slide them in the direction in which they approach each other and move away from each other, and a setting means for starting up the drive unit so as to set an interval defined between the opposed paper delivery side fences to an interval determined according to the size of the transfer paper, which has been recognized by the paper size recognizing means. The size of the transfer paper discharged into the paper delivery unit is recognized by the paper size recognizing means and the interval defined between the opposed paper delivery side fences is automatically set to the interval according to the recognized size of transfer paper. It is thus unnecessary to execute the work of a manual adjustment to the paper delivery side fences.

The recognition of the size of the transfer paper by the paper size recognizing means is performed by detecting the size of each transfer paper loaded into the paper feeding unit, using a plurality of sensors, for example.

A paper delivery end fence provided within a paper delivery unit and slidable in a paper delivery forward or reverse direction, a drive unit for driving the paper delivery end fence so as to slide it in the paper delivery forward or reverse direction, and a setting means for starting up the drive unit so as to set the position of the paper delivery end fence to a position corresponding to the result of detection by the paper size recognizing means may be additionally provided. Thus, the position of the paper delivery end fence can be automatically set to the position corresponding to the transfer paper size recognized by the paper size recognizing means. In this case, the work of a manual adjustment to the paper delivery end fence becomes unnecessary.

A paper delivery timing recognizing means for recognizing the timing provided to discharge or deliver transfer paper to the paper delivery unit, and a first jogger operation executing means for applying a signal for driving a pair of paper delivery side fences in the forward or reverse direction to the drive unit for the side fences in the timing provided to discharge the transfer paper, which has been recognized by the paper delivery timing recognizing means to thereby allow the paper delivery side fence pair to perform a jogger operation may be additionally provided. Moreover, a second jogger operation executing means for supplying a signal for driving the paper delivery end fence in the forward or reverse direction to the drive unit for the paper delivery end fence in the timing provided to discharge the transfer paper, which has been recognized by the paper delivery timing recognizing means to thereby allow the paper delivery end fence to perform the jogger operation may be provided. In these cases, the timing provided to discharge the transfer paper to the paper delivery unit is recognized by the paper delivery timing recognizing means and the jogger operations of the paper delivery side fence pair and the paper delivery end fence are performed in that timing. Namely, the paper delivery side fence pair and the paper delivery end fence move forward and backward alternately in units of several mm, whereby the transfer paper is properly positioned. Since the jogger operation is carried out using the drive units for driving the paper delivery side fence pair and the paper delivery end fence at this time, a special power translation or conversion mechanism for the jogger operation is unnecessary and the structure of the image forming apparatus can be avoided from increasing in complexity.

If a resetting means is provided and the drive unit is started up after the completion of an image forming operation so as to slide the paper delivery side fence pair in the direction in which the interval between the opposed paper delivery side fences expands and to slide the paper delivery end fence in a paper-delivery normal direction, it is then easy to take out the delivered transfer paper.

If the setting means is activated only when no sheets of transfer paper exist in the paper delivery unit, the transfer paper can be prevented from being damaged due to the sliding of the paper delivery side fence pair and the paper delivery end fence when the transfer paper have been discharged into the paper delivery unit in advance.

It is expected that the paper delivery side fence pair and the paper delivery end fence must be manually slid in some cases due to the situation that, for example, the paper delivery side fence pair and the paper delivery end fence are allowed to correspond to transfer paper of irregular-form sizes. If, in this case, a motor requiring a reduction mechanism as the drive unit is used and a clutch is provided in the course of a route for driving the motor and held in a connected state only when a driven unit is driven by the motor, no resistance to the reduction mechanism of the drive unit occurs upon sliding of the paper delivery side fence pair and the paper delivery end fence, whereby the paper delivery side fence pair and the paper delivery end fence can be slid under small forces. If a stepping motor is used as the drive unit, it is the n unnecessary to provide the reduction mechanism of the drive unit. Even in this case, the paper delivery side fence pair and the paper delivery end fence can be slid under the small forces. When the interval defined between the opposed paper delivery side fences, which has been set by the setting means, is fine-adjusted at this time, the fine-adjusted opposed interval between the paper delivery side fences and the position of the paper delivery end fence can be easily reproduced at all times if a storing means for storing, as discrete information, the fine-adjusted interval defined therebetween and the position of the paper delivery end fence is provided.

Further, when a pair of paper feeding side fences whose at least one is slidable in a paper width direction, is provided within the paper feeding unit, the paper size recognizing means detects, for example, an interval defined between the opposed paper feeding side fences so as to recognize the size of transfer paper. In this case, the interval between the opposed paper feeding side fences is easily detected by, for example, detecting the rotation of a rotating member activated in interlock with the sliding operation of the paper feeding side fence pair by the use of an absolute type encoder.

2. A first Embodiment of the Present Invention

The first embodiment of the present invention will hereinafter be described based on FIGS. 2 through 10. The present embodiment shows an embodiment applied to a stencil printer 1. Since the basic structure of the stencil printer 1 for performing printing using a stencil or a master 2 with perforated images formed thereon is already known, the basic structure thereof will be described in brief. The stencil printer 1 will first be described.

[Stencil printer]

Figure 2:
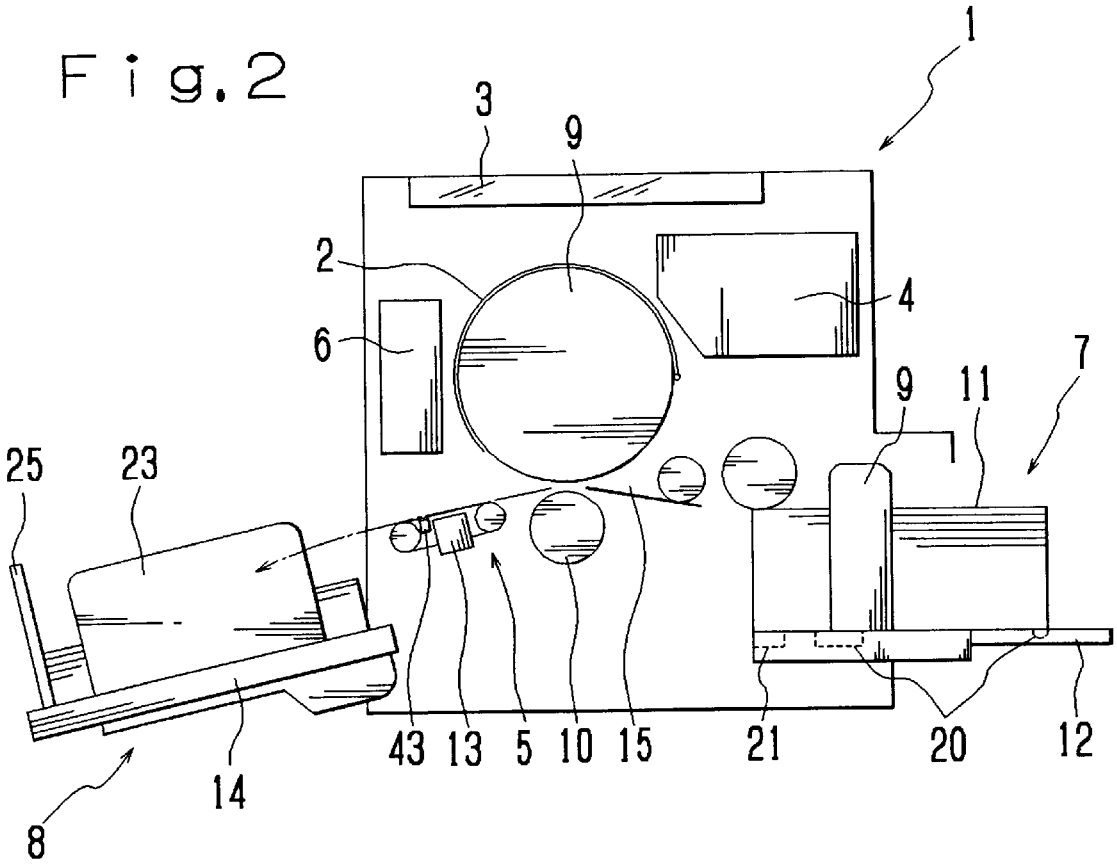
FIG. 2 is a general longitudinal cross-sectional side view illustrating a first embodiment of the present invention.

FIG. 2 is a longitudinal cross-sectional front view of the stencil printer 1.

As a schematic structure, the stencil printer 1 comprises an optical reader 3, a stencil perforating unit or a plate-making unit 4, a print unit 5, a used stencil take-up unit or a plate-discharging unit 6, a paper feeding unit 7, and a paper delivery unit 8.

The optical reader 3 has a structure as a digital scanner for optically reading an image formed on an unillustrated original.

The plate-making unit 4 has a structure which perforates the master 2 by heating so as to form the original image read by the optical reader 3 on the master 2 as a perforated image and feeds it to the print unit 5. In this case, the master 2 is wound and held in roll form and drawn to a predetermined path or route so as to be perforated by heating. Further, the master 2 subsequent to the formation of the perforated image is cut to a predetermined length, followed by delivery to the print unit 5.

The print unit 5 has a plate cylinder 9 as a principal component. The plate cylinder 9 is one in which holes having diameters ranging from about 0.15 mm to 0.5 mm are defined in its outer peripheral surface at intervals ranging from about 0.25 mm to 1.0 mm. The plate cylinder 9 is rotatably driven with a support shaft or spindle as its center. Such a plate cylinder 9 is formed so as to be able to support or keep the master 2 delivered from the plate-making unit 4 and wind or wrap and hold it thereon. Further, the print unit 5 has an unillustrated ink supplier provided inside the plate cylinder 9 and a press roller 10 brought into contact with the outer peripheral surface of the plate cylinder 9. Namely, the print unit 5 has a structure in which the ink supplier supplies suitable ink to the inside of the plate cylinder 9, which corresponds to a transfer position and the press roller 10 applies pressure to the plate cylinder 9 so as to be deformed, whereby the ink is allowed to lead to the outer peripheral surface of the plate cylinder 9 from the inner peripheral surface thereof. Thus, when the ink leaks from the plate cylinder 9, a sheet of transfer paper 11 is allowed to pass between the plate cylinder 9 and the press roller 10 using the passage of the ink through the holes defined in the master 2 wound around the plate cylinder 9 to thereby form an image on the transfer paper 11. This is the principle of printing by the print unit 5.

The plate-discharging unit 6 has a structure in which it receives the master 2 after its usage from the plate cylinder 9 and holds it therein.

The paper feeding unit 7 has a structure in which it separates sheets of transfer paper 11 placed on a paper feeding table 12 in a stacked state from each other and supplies one of them so as to be introduced between the plate cylinder 9 and the press roller 10. The paper feeding unit 7 and the paper delivery unit 8 are connected to each other by a paper passage route 15 so that the transfer paper 11 introduced between the plate cylinder 9 and the press roller 10 is conveyed to a belt conveyor 13 so as to reach a paper delivery table 14 of the paper delivery unit 8. The paper feeding unit 7 and the paper delivery unit 8 will be described in detail later.

Figure 8:
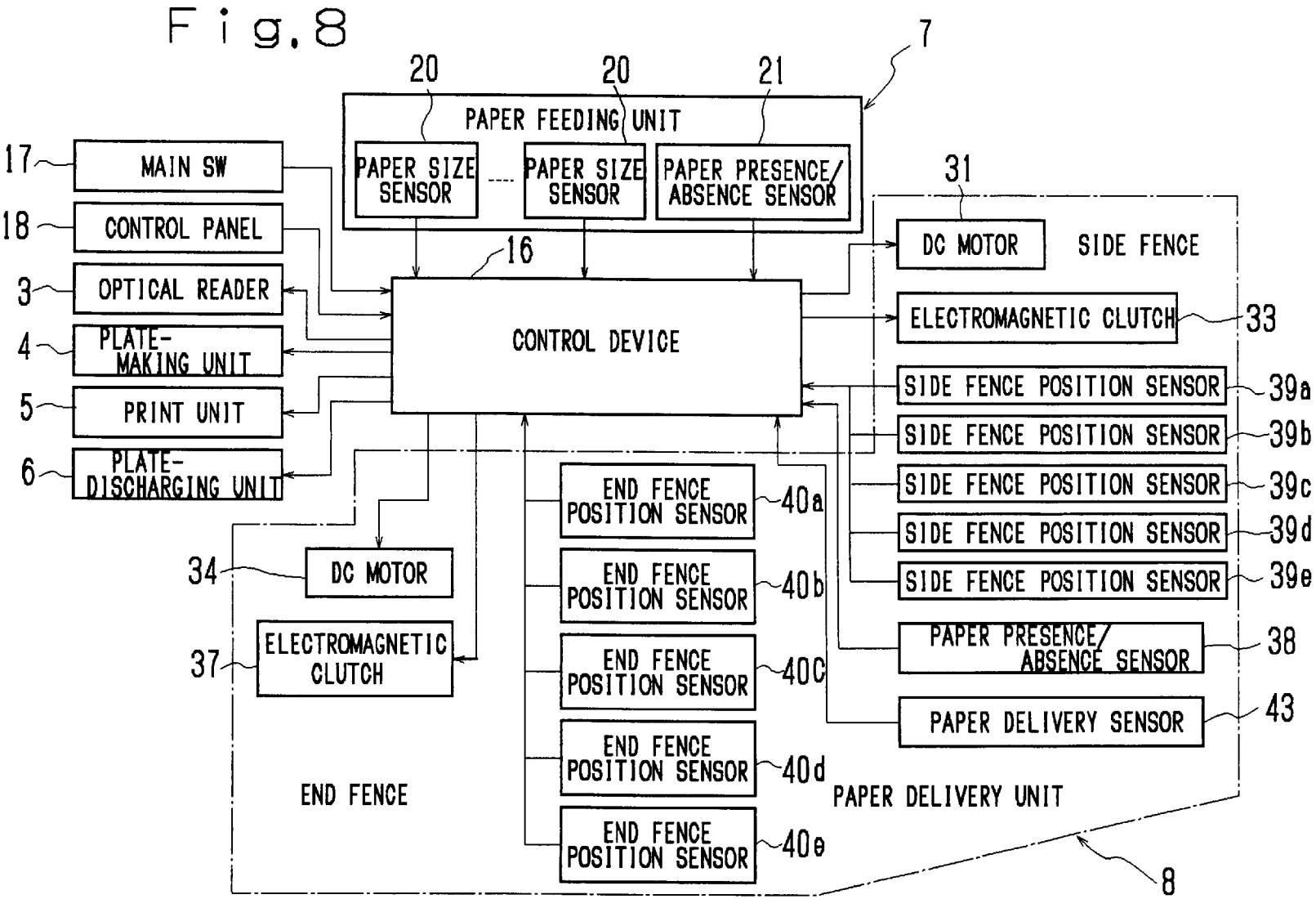
FIG. 8 is a block diagram showing electrical connections between respective components.

FIG. 8 is a block diagram showing electrical connections of a control system. The aforementioned operations of respective portions are performed by the control system shown in FIG. 8. The control system has a control device 16 of a microcomputer configuration, which is comprised of a CPU and a memory both not shown, as a principal component. Connected to the control device 16 are a main switch 17, a control panel 18, an optical reader 3, a plate-making unit 4, a print unit 5, a plate-discharging unit 6, a paper feeding unit 7 and a paper delivery unit 8.

Under such a construction, the stencil printer 1 performs, as basic operations, the operation of plate-making the master 2 by the plate-making unit 4 on the basis of the original image read by the optical reader 3 and the operation of transferring the original image onto the transfer paper 11, using the after-plate-making master 2 and printing it thereon. These operations are continuously executed under the depression of an unillustrated start key in the control panel 18.

The plate-making operation will be described. When the start key is first depressed, the used master 2 wound around the plate cylinder 9 is dumped into the plate-discharging unit 6. The plate-making operation is ready in this way. As the substantial plate-making operation, the master 2 is perforated under heating so that a perforated image based on the original image read by the optical reader 3 is formed on the master 2. Next, the master 2 perforated under heating is cut to a predetermined length, followed by delivery to the print unit 5.

The printing operation will be described. In the print unit 5, the plate cylinder 9 holds the master 2 with the perforated image formed thereon, which has been conveyed from the plate-making unit 4. In this condition, the plate cylinder 9 is rotated so that the master 2 is wound around the plate cylinder 9. Hence the transfer paper 11 is conveyed from the paper feeding unit 7 to the plate cylinder 9 in synchronism with the rotation of the plate cylinder 9 and the press roller 10 depresses the plate cylinder 9 with the master 2. Accordingly, the ink leaks from the inside of the plate cylinder 9 supplied with the ink by the ink supplier to the outside thereof. The leakage ink passes through each perforation defined in the master 2 so as to be transferred to the transfer paper 11. Thus, the perforated image formed on the master 2 is transferred to the transfer paper 11 to perform its printing.

[Paper feed/delivery mechanism]

A paper feed/delivery mechanism including the paper feeding unit 7 and the paper delivery unit 8 will next be described.

Figure 3:
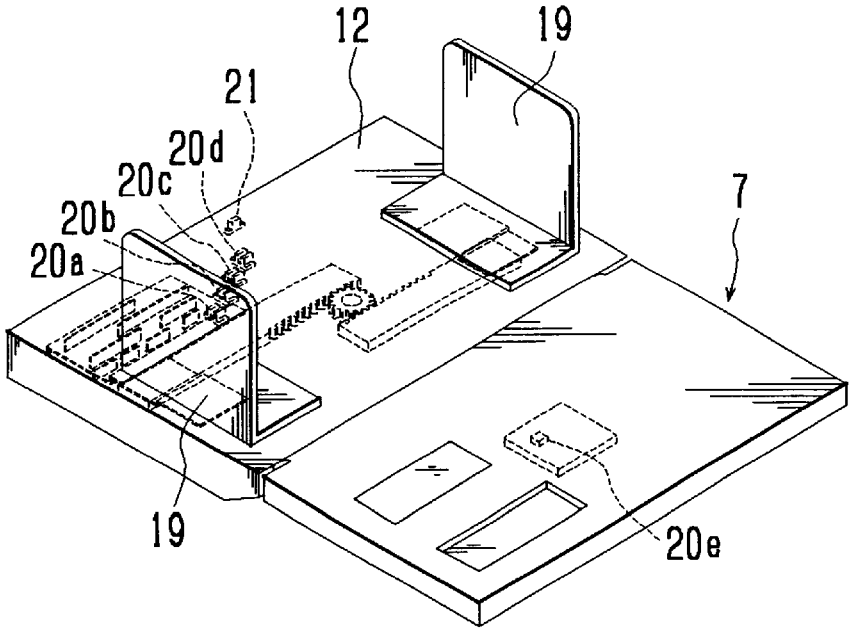
FIG. 3 is a see-through perspective view depicting a paper feeding table.
Figure 4:
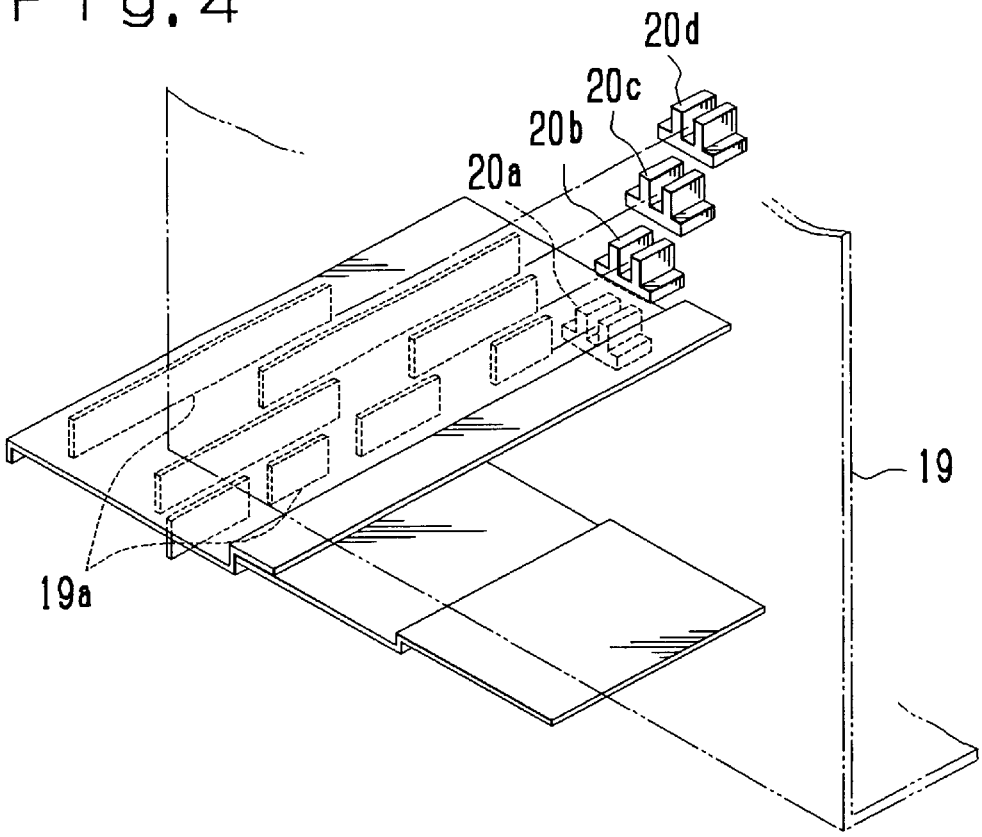
FIG. 4 is a perspective view showing a structure for detecting the size of transfer paper placed on the paper feeding table shown in FIG. 3.

FIG. 3 is a see-through perspective view of the paper feeding table 12. FIG. 4 is a perspective view showing a structure for detecting the size of each of sheets of transfer paper 11 set on the paper feeding table 12. A pair of paper feeding side fences 19 opposite to the paper feeding table 12 is attached to the paper feeding unit 7. These paper feeding side fences 19 are provided slidably in a paper transverse or paper-width direction. Further, four paper size sensors 20*a* through 20*d* are provided on the paper feeding table 12 in a row along the direction of sliding of the paper feeding side fences 19. At least one paper size sensor 20*e* used for the detection of the size of each paper extending in the paper-feeding direction is provided on the upstream side of the paper feeding unit 7, whereas a paper presence/absence sensor 21 is provided on the downstream side thereof. The paper size sensors 20*a* through 20*d* are light-transmissive sensors and both the paper size sensor 20*e* and the paper presence/absence sensor 21 are light-reflective sensors. They are electrically connected to the control device 16 so as to apply on/off signals to the control device 16. Thus, they are used to detect the size and presence/absence of the transfer paper 11 placed on the paper feeding table 12. Described in more detail, a plurality of light-proof plates 19*a* displaced integrally with the paper feeding side fences 19 are fixed to a lower portion of one paper feeding side fence 19 in predetermined patterns. The light-proof plates 19*a* shield the four paper size sensors 20*a* through 20*d* from light in predetermined patterns according to the position of each paper feeding side fence 19. Further, patterns outputted from the paper feeding size sensors 20 corresponding to five in total, are changed under the sensing of another paper size sensor 20*e*. The control device 16 is constructed so as to recognize the size of each transfer paper 11 placed on the paper feeding table 12 based on the output patterns of the paper size sensors 20.

Figure 5:
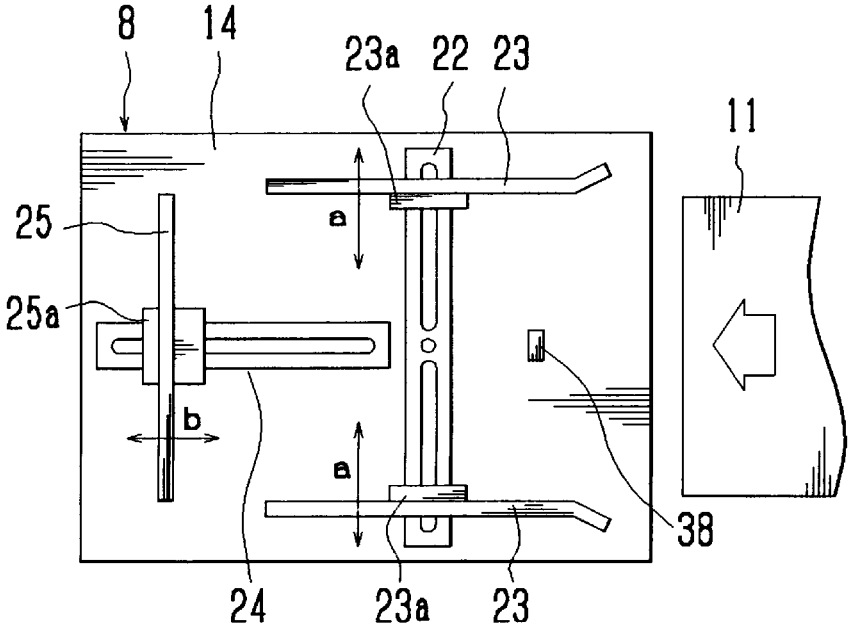
FIG. 5 is a plan view illustrating the paper delivery table.

FIG. 5 is a plan view of the paper delivery table 14. The paper delivery table 14 has a pair of paper delivery side fences 23 attached slidably to a guide rail 22 through sliders 23*a* and a paper delivery end fence 25 attached slidably to a guide rail 24 through a slider 25*a*. The paper delivery side fence pair 23 is slidable in the direction of width of each delivered transfer paper 11 (i.e., in the directions indicated by arrows a in FIGS. 5 and 6), whereas the paper delivery end fence 25 is slidable in the normal or reverse direction in which the transfer paper 11 is delivered or discharged (i.e., in the directions indicated by arrows b in FIGS. 5 and 6).

Figure 6:
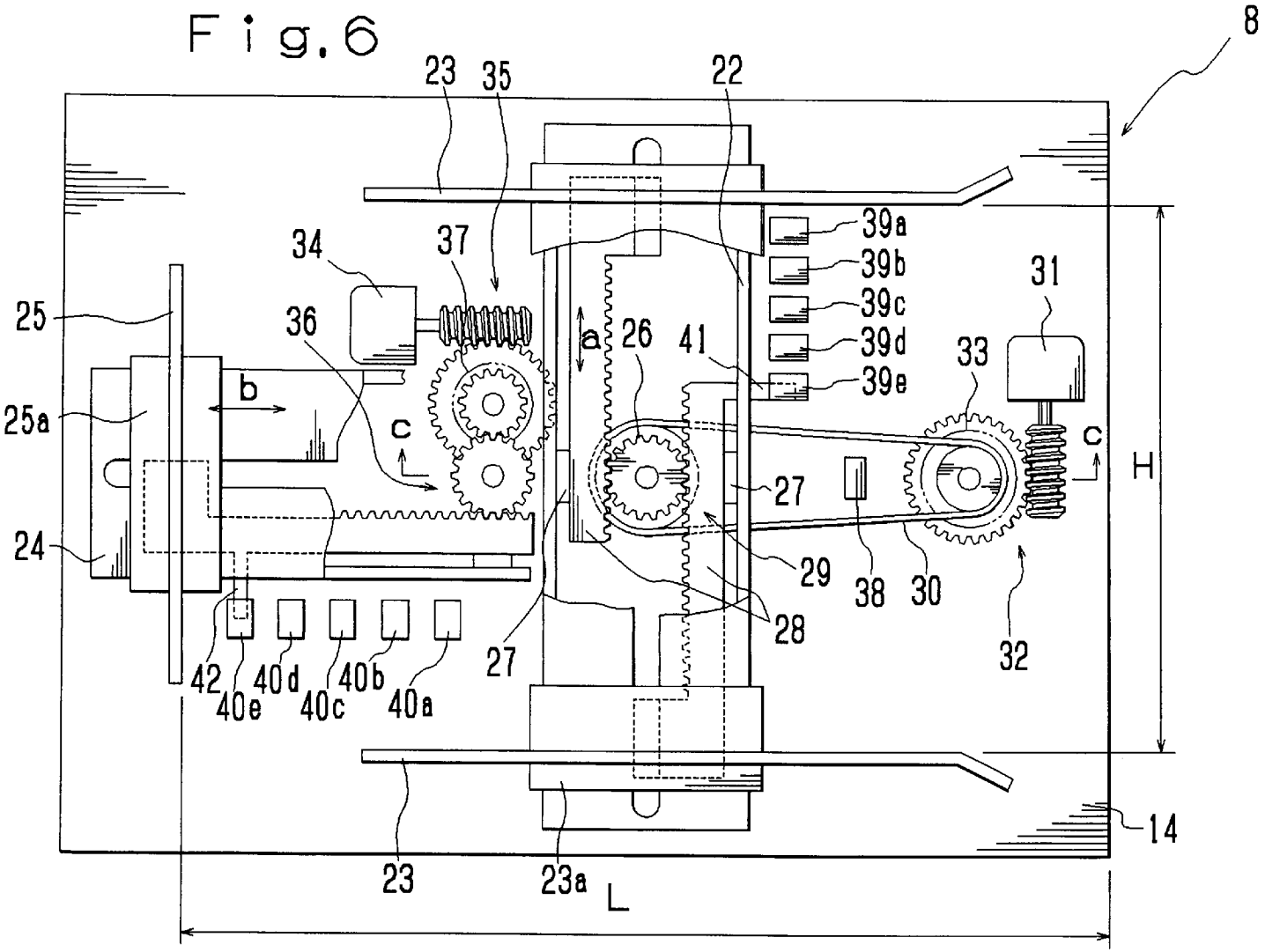
FIG. 6 is a plan view depicting the structure of a paper delivery unit with the paper delivery table partly cut-off.
Figure 7:
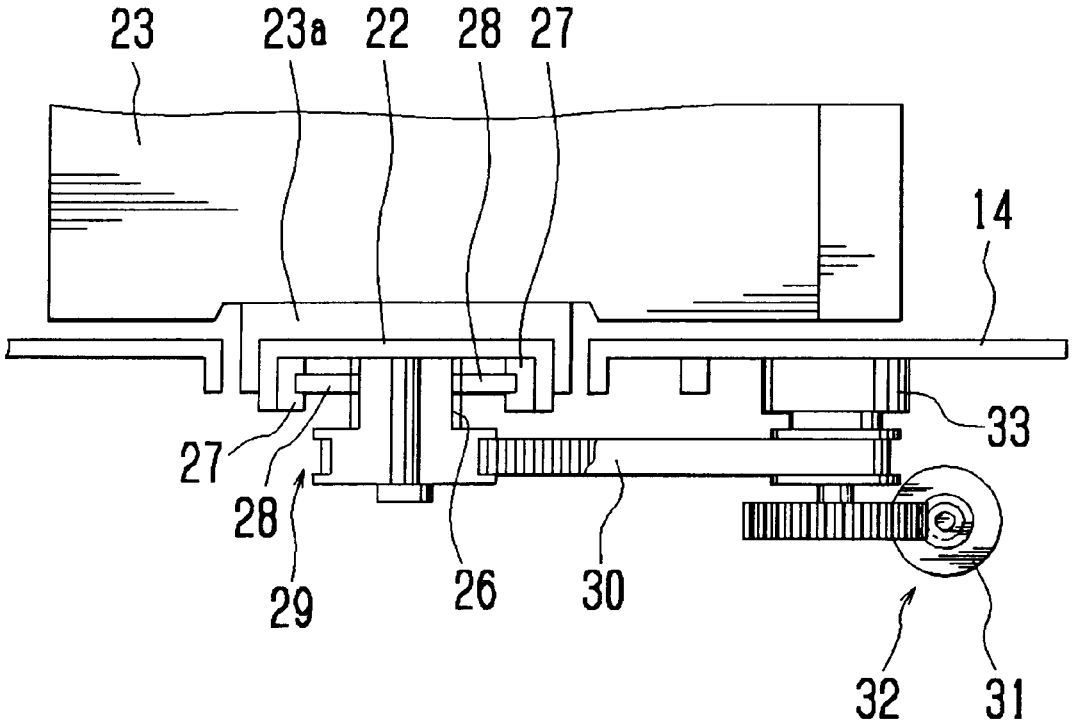
FIG. 7 is a cross-sectional view taken along line C—C in FIG. 6.

FIG. 6 is a plan view showing the manner in which the paper delivery table 14 is cut away to illustrate the structure of the paper delivery unit 8. FIG. 7 is a cross-sectional view taken along line C—C in FIG. 6 showing the structure of the paper delivery unit 8. The paper delivery side fence pair 23 is coupled to a rack-and-pinion mechanism 29 composed of a pinion gear 26 rotatably attached to the back of the guide rail 22 and racks 28 respectively guided by slip guides 27 attached to the back of the guide rail 22. Further, the paper delivery side fences 23 are slid in interlock with each other. The pinion gear 26 that constitutes a part of the rack-and-pinion mechanism 29, is coupled via a timing belt 30 to a worm gear mechanism 32 driven by a DC motor 31 used as a drive unit connected to the control device 16 and a motor. The worm gear mechanism 32 serves as a reduction mechanism for the DC motor 31 and has an electromagnetic clutch 33 used as a clutch, which is connected to the control device 16 and driven and controlled by the control device 16. Thus, only when the electromagnetic clutch 33 is turned on, a driving force produced from the DC motor 31 is transferred to the paper side fence pair 23 through the worm gear mechanism 32, timing belt 30 and rack-and-pinion mechanism 29.

Further, the paper delivery end fence 25 is constructed so as to be driven by both a worm gear mechanism 35 driven by a DC motor 34 used as a drive unit connected to the control device 16 and a motor, and a rack-and-pinion mechanism 36 coupled to the worm gear mechanism 35. The worm gear mechanism 35, which takes or supports the transfer of power to the paper delivery end fence 25, also serves as a reduction mechanism for the DC motor 34 and has an electromagnetic clutch 37 used as a clutch, which is connected to the control device 16 and driven and controlled by the control device 16.

A paper presence/absence sensor 38 of a light-reflective sensor configuration for detecting the presence or absence of each transfer paper 11 placed on the paper delivery table 14, side fence position sensors 39 and end fence position sensors 40 are provided on the paper delivery table 14 and respectively electrically connected to the control device 16.

The side fence position sensors 39 are five light-reflective sensors 39*a* through 39*e* for detecting the presence or absence of a detecting piece 41 projecting from one rack 28 of the rack-and-pinion mechanism 29 at five points along the paper transverse direction. When the sensor 39*a* of the side fence position sensors 39 is turned on, an interval H defined between the opposed paper delivery side fences 23 is set to 182 mm (corresponding to a longitudinal B5-size). When the sensor 39*b* is turned on, the interval H1 is set to 210 mm (corresponding to a longitudinal A4-size). When the sensor 39*c* is turned on, the interval H is set to 257 mm (corresponding to each of a longitudinal B4-size and a transverse B5-size). When the sensor 39*d* is turned on, the interval H is set to 297 mm (corresponding to each of a longitudinal A3-size and a transverse A4-size). When the sensor 39*e* is turned on, the interval H is set to 310 mm (home position).

The end fence position sensors 40 are five light-reflective sensors 40*a* through 40*e* for detecting the presence or absence of a detecting piece 42 projecting from a rack of the rack-and-pinion mechanism 36 at five points along the paper delivery direction. When the sensor 40*a* of the end fence position sensors 40 is turned on, a paper length L applicable to the paper delivery table 14, which is determined according to the position of the paper delivery end fence 25, is set to 210 mm (corresponding to each of a transverse B5-size and a transverse A4-size). When the sensor 40*b* is turned on, the paper length L is set to 257 mm (corresponding to a longitudinal B5-size). When the sensor 40*c* is turned on, the paper length L is set to 297 mm (corresponding to a longitudinal A4-size). When the sensor 40*d* is turned on, the paper length L is set to 364 mm (corresponding to a longitudinal B4-size). When the sensor 40*e* is turned on, the paper length L is set to 420 mm (corresponding to a longitudinal A3-size).

As shown in FIG. 2, the belt conveyor 13 for delivering or discharging each transfer paper 11 to the paper delivery table 14 is provided with a light-reflective paper delivery sensor 43 for detecting the passage of the transfer paper 11. The function of the paper delivery sensor 43 will be described later.

The stencil printer 1 according to the present embodiment has a paper size recognizing means, a setting means, a resetting means, a paper delivery timing recognizing means and a jogger operation executing means as various means executed under the operation of the microcomputer in the control device 16. The paper size recognizing means recognizes the size (width and length) of each transfer paper 11 subjected to printing by the print unit 5 and delivered to the paper delivery table 14. Namely, when the output patterns of the paper size sensors 20*a* through 20*e* in the paper feeding unit 7 are inputted to the control device 16, the size of the transfer paper 11 is recognized by the performance of arithmetic processing of the control device 16. The setting means starts the DC motors 31 and 34 so as to set the interval between the opposed paper delivery side fences 23 and the position of the paper delivery end fence 25 according to the size of the transfer paper 11, which has been recognized by the paper size recognizing means. Namely, since the opposite interval therebetween is detected by each side fence position sensor 39, the setting means turns the electromagnetic clutch 33 on and thereby starts up the DC motor 31 until the interval between the paper delivery side fences 23 is set to a desired opposite interval. Further, since the position of the paper delivery end fence 25 is detected by each end fence position sensor 40, the setting means turns the electromagnetic clutch 37 on and thereby starts up the DC motor 34 until the position of the paper delivery end fence 25 is set to a desired position. At this time, the setting means is activated only when the paper presence/absence sensor 21 in the paper feeding unit 7 detects the transfer paper 11 and the paper presence/absence sensor 38 in the paper delivery unit 8 does not detect the transfer paper 11. After the completion of the printing operation of the stencil printer 1, the resetting means starts the DC motor 31 to slide the paper delivery side fence pair 23 to the home position. Further, the resetting means starts the DC motor 34 to slide the paper delivery end fence 25 until the paper length L suitable for the paper delivery table 14 is brought to the maximum. The paper delivery timing recognizing means is a means for recognizing the timing provided to deliver or discharge the transfer paper 11 to the paper delivery table 14 based on the output of the paper delivery sensor 43 provided within the belt conveyor 13 inside the stencil printer 1. Namely, the paper delivery timing is recognized by recognizing the signal outputted from the paper delivery sensor 43, which is changed due to the attainment of the leading end of the transfer paper 11 to the paper delivery sensor 43, using the microcomputer in the control device 16. The jogger operation executing means is a means for supplying irreverse and reverse signals to the DC motors 31 and 34 so as to reciprocate the paper delivery side fence pair 23 and the paper delivery end fence 25 by about several millimeters according to the recognition of the paper delivery timing by the paper delivery timing recognizing means. The reciprocating motion at this time corresponds to the operation for returning the fence-to-fence interval to the normal interval after the interval has firstly been opened up.

The operation of the present embodiment will next be described.

Figure 9:
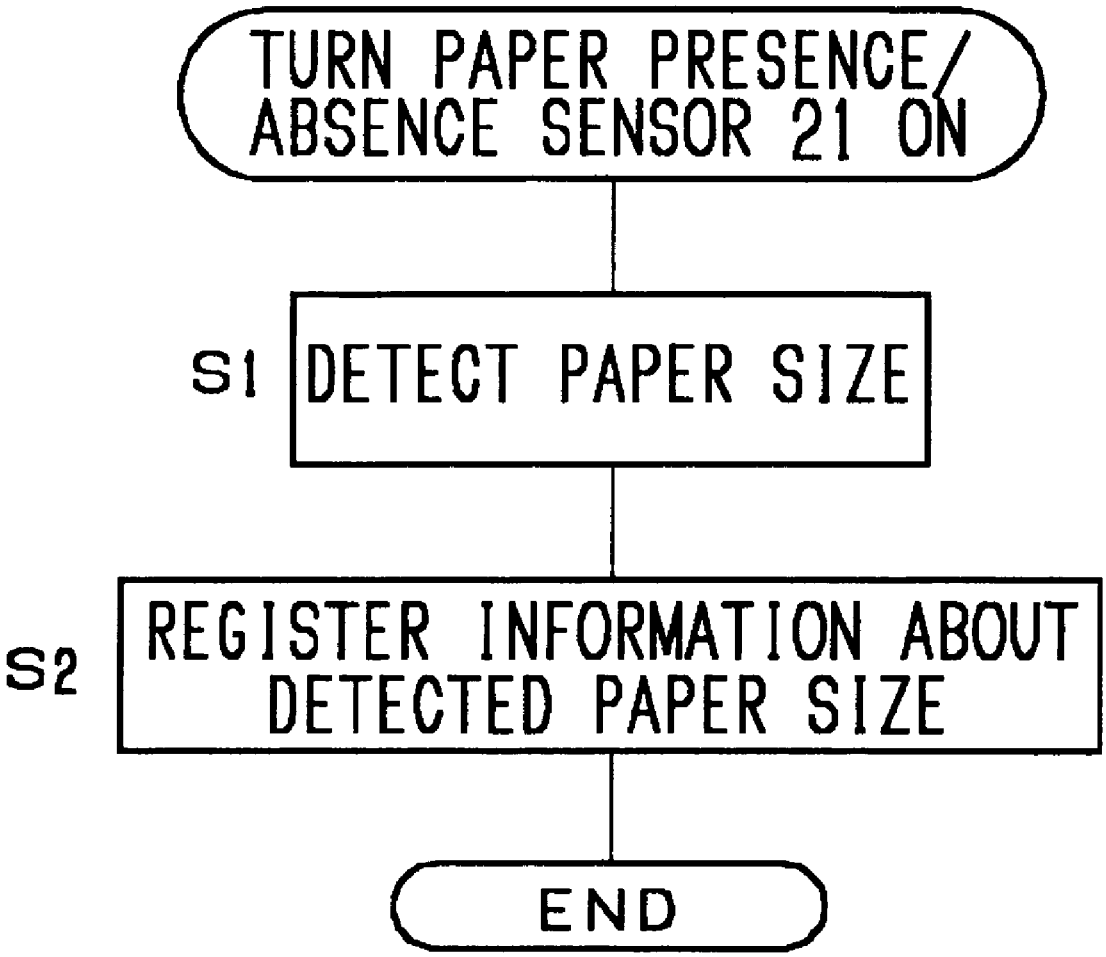
FIG. 9 is a flowchart for describing the flow of a process at the time that sheets of transfer paper are placed on the paper feeding table.

FIG. 9 is a flowchart for describing the flow of a process at the time that each transfer paper 11 is placed on the paper feeding table 12. When sheets of transfer paper 11 to be printed by the print unit 5 is placed on the paper feeding table 12 upon turning on the main switch 17, the paper size recognizing means recognizes the size (width and length) of the transfer paper 11. Namely, the output of the paper presence/absence sensor 21 provided within the paper feeding table 12 changes due to the placement of the transfer paper 11 on the paper feeding table 12, whereby a paper size detecting process is executed. In other words, the size of the transfer paper 11 is detected based on the patterns outputted from the five paper size sensors 20*a* through 20*e* (Step S1) and information about the detected size of transfer paper 11 is temporarily stored in a registration (or regist) region of the microcomputer provided in the control device 16 (Step S2).

Figure 10:
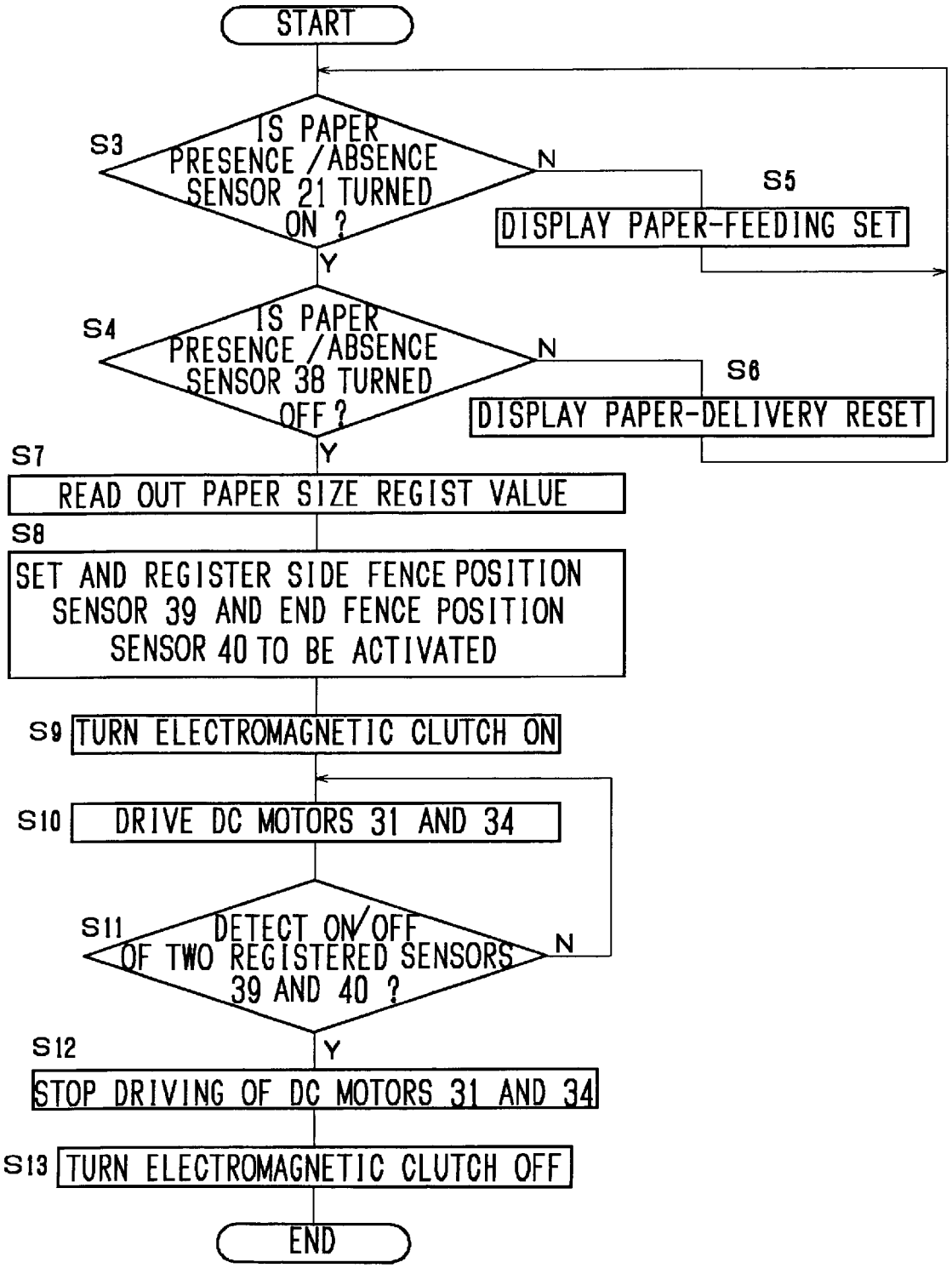
FIG. 10 is a flowchart for describing a process for adjusting a pair of paper-delivery side fences and a paper-delivery end fence.

FIG. 10 is a flowchart for describing the flow of a process for setting the interval between the opposed paper delivery side fences 23 and the position of the paper delivery end fence 25. A process for confirming the turning o,n of the paper presence/absence sensor 21 on the paper feeding table 12 is executed (Step S3). A process for confirming the turning off of the paper presence/absence sensor 38 on the paper delivery table 14 is executed (Step S4). Namely, it is confirmed in Steps S3 and S4 that the sheets of transfer paper 11 have been placed on the paper feeding table 12 and no sheets of transfer paper 11 exist in the paper delivery table 14. When no sheets of transfer paper 11 are placed on the paper feeding table 12, a paper-feeding set indication is made on an unillustrated display provided within the control panel 18 (Step S5). When some sheets of transfer paper 11 remain in the paper delivery table 14, a paper-delivery reset indication is made on the display (Step S6). Namely, the interval between the opposed paper delivery side fences 23 and the position of the paper delivery end fence 25 are automatically set only when the sheets of transfer paper 11 exist in the paper feeding unit 7 and no transfer paper 11 exist in the paper delivery unit 8. It is therefore possible to avoid inconvenience that, for example, the automatic setting of the interval between the opposed paper delivery side fences 23 is uselessly performed even though the printing operation is not performed and the automatic setting of the interval between the opposed paper delivery side fences 23 is performed even though the transfer paper 11 still remains in the paper delivery table 14, so that the transfer paper 11 is scratched.

When the placement of the transfer paper 11 on the paper feeding table 12 and the non-placement of the transfer paper 11 on the paper delivery table 14 are confirmed, the setting means in the paper delivery unit 8 sets the interval defined between the paper delivery side fences 23 and the position of the paper delivery end fence 25 to an interval and a position determined according to the size of the transfer paper 11, which has been recognized by the paper size recognizing means. Namely, the interval defined between the opposed paper delivery side fences 23 and the position of the paper delivery end fence 25 are automatically set according to the size of the discharged transfer paper 11. As a process for this automatic setting, the paper size registration (or regist) value registered in Step S2 in FIG. 9 is read out from the regist region (Step S7). Further, the side fence position sensors 39 and the end fence position sensors 40 to be made active are set and registered (Step S8). Namely, it is determined as to which turning-on of side fence position sensor of the side fence position sensors 39*a* through 39*e* should be detected and which turning-on of end fence position sensor of the end fence position sensors 40*a* through 40*e* should be detected. Thereafter, information about its determination is temporarily stored in the regist region. Next, the electromagnetic clutches 33 and 37 are turned on (Step S9) and the DC motors 31 and 34 are driven (Step S10). Thus, the paper delivery side fences 23 are slid so as to lessen the interval defined therebetween and the paper delivery end fence 25 is slid so that its position is shifted to the upstream side as seen in the paper delivery direction. If it is recognized in Step S8 that the side fence position sensor 39 and the e:ad fence position sensor 40 whose both information are temporarily stored in the regist region, have been turned on (Step S11), then the DC motors 31 and 34 stop driving (Step S12) and the electromagnetic clutches 33 and 37 are turned off (Step S13). As a result, the interval defined between the opposed paper delivery side fences 23 and the position of the paper delivery end fence 25 are automatically set. The work for manually setting these by an operator becomes unnecessary and they are set extremely accurately. In fact, there may be cases in which the interval between the paper delivery side fences 23 is set so as to be slightly wider or narrower than the actual size of the corresponding transfer paper 11 according to the type i.e., the quality of the paper material or thickness of corresponding transfer paper 11. Since the transfer paper 11 is deformed into an inverted U-shaped form due to swelling produced by the water of ink on the printing surface side, the transfer paper 11 is forcibly bent into a U-shaped form so as to cancel it and is discharged in this condition. However, since the U-shaped form thereof is expressed in multifarious ways according to the type and thickness of paper in this case, it is necessary to make the interval defined between the opposed paper delivery side fences 23 slightly wide or narrow according to the transfer paper 11 to be used.

It is expected that the paper delivery side fences 23 and the paper delivery end fence 25 must be manually slid in some cases due to the situation that, for example, the paper delivery side fence pair and the paper delivery end fence are allowed to correspond to transfer paper of irregular-form sizes. Since, in this case, the electromagnetic clutches 33 and 37 are provided in the course of a power transfer route extending from the DC motors 31 and 34 to the paper delivery side fences 23 and the paper delivery end fence 25, and are normally held in an off state, no resistance to the reduction mechanism of the DC motors 31 and 34 occurs upon sliding of the paper delivery side fence pair 23 and the paper delivery end fence 25 by the manual operation. Thus, the paper delivery side fences 23 and the paper delivery end fence 25 can be slid by small forces and hence workability can be made satisfactory.

When the unillustrated start key on the control panel 18 is depressed after the setting of the positions of the paper delivery side fence pair 23 and the paper delivery end fence 25, the printing operation is performed.

Upon its implementation, the paper size may be inputted through the control panel 18. In this case, a process for allowing the control device 16 to store the paper size inputted through the control panel 18 corresponds to the paper size recognizing means.

Upon its implementation, the setting of both the interval between the paper delivery side fences 23 and the position of the paper delivery end fence 25 in the paper delivery unit 8 by the setting means may be executed in timing provided to depress the unillustrated start key on the control panel 18.

3. A second embodiment of the present invention

Figure 12:
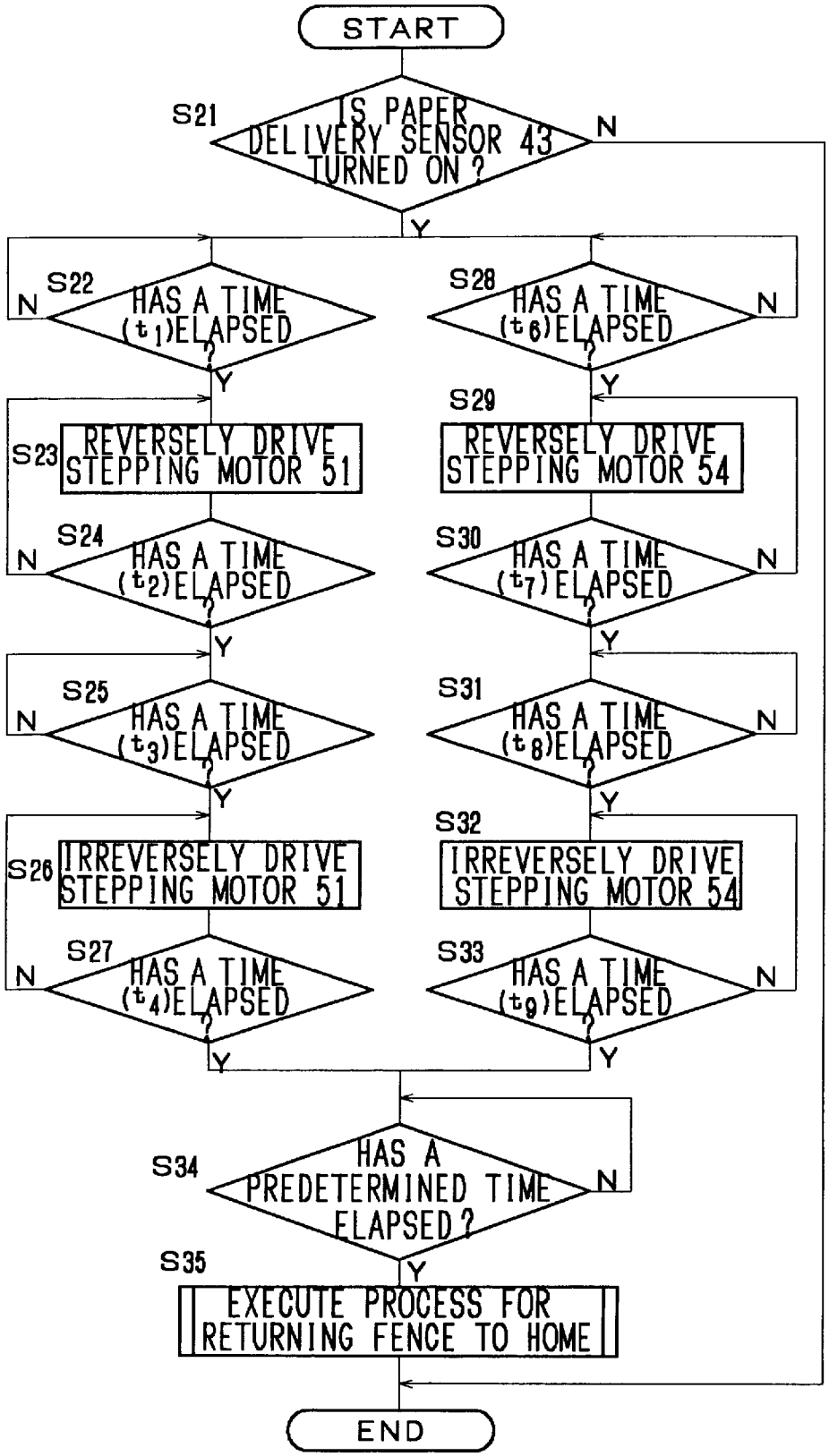
FIG. 12 is a flowchart for explaining the flow of an after-printing process including a jogger operation.
Figure 13:
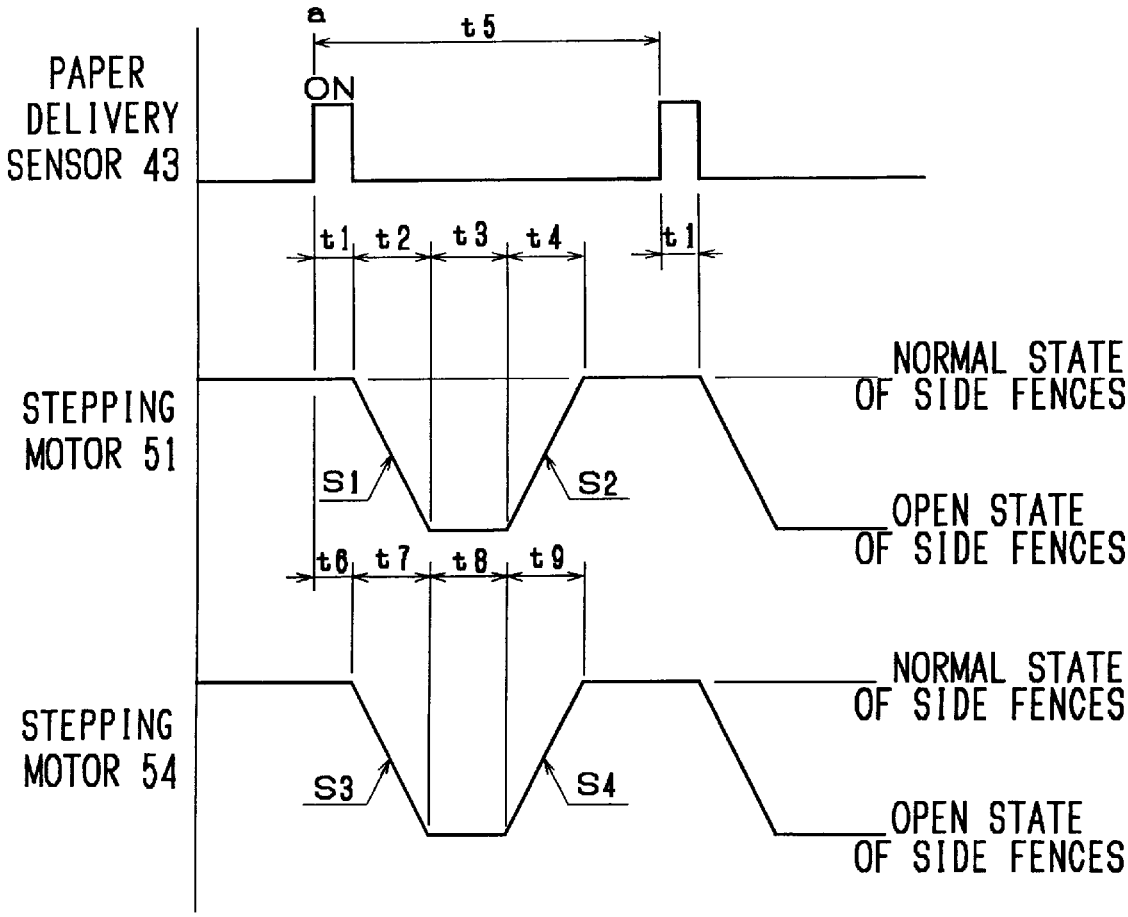
FIG. 13 is a timing chart for describing respective operations for the flow of the after-printing process.

The second embodiment of the present invention will be described based on FIGS. 11 through 13. The same elements of structure as those employed in the first embodiment are identified by the same reference numerals and their description will be omitted.

Figure 11:
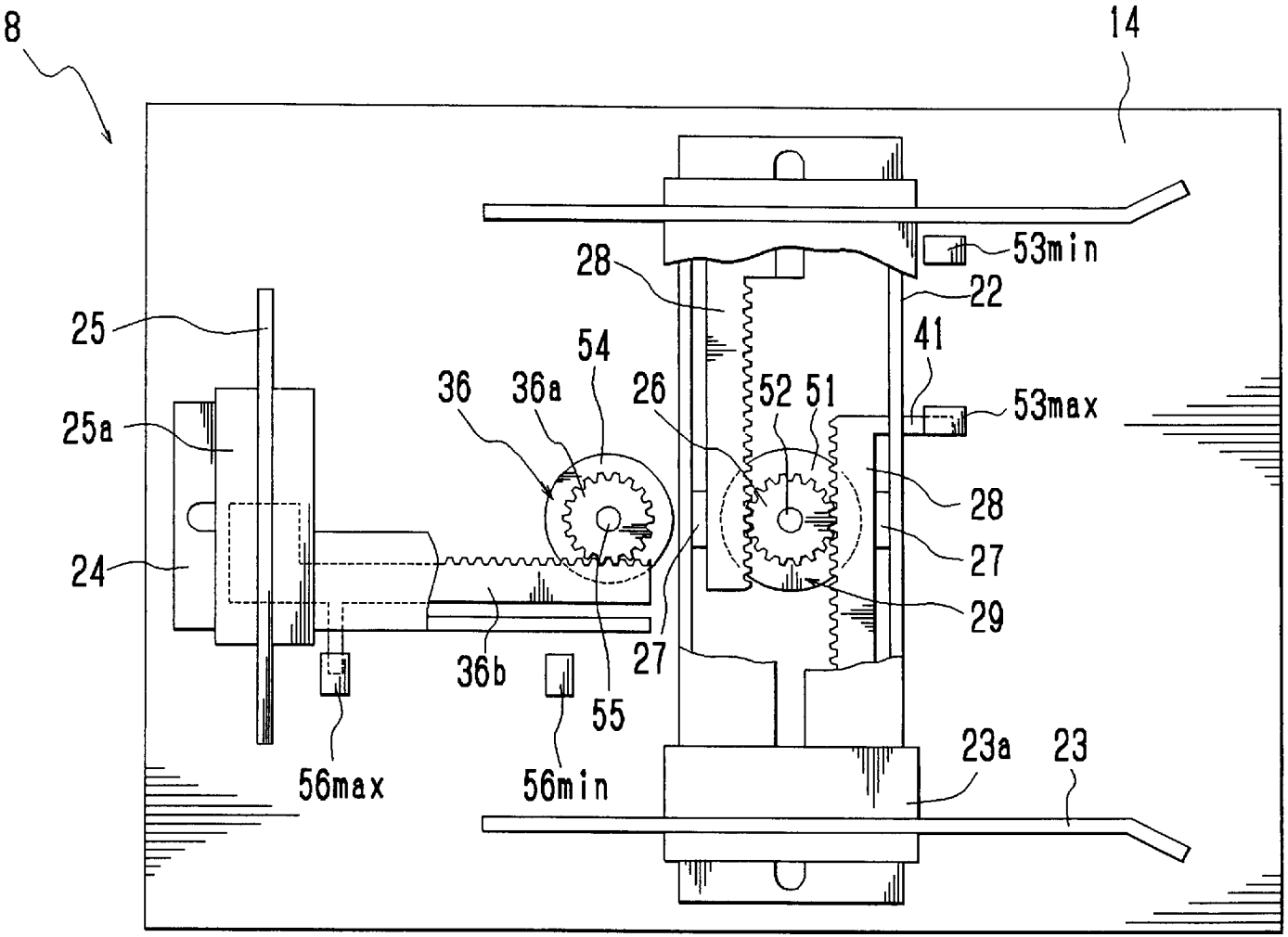
FIG. 11 is a plan view showing the structure of a paper delivery unit with a paper delivery table partly cut off.

FIG. 11 is a plan view showing the structure of a paper delivery unit in a state in which a paper delivery table is being partly cut away. In the present embodiment, a stepping motor 51 is used as a drive source for a pair of paper delivery side fences 23. A drive shaft 52 of the stepping motor 51 is directly coupled to a pinion gear 26 of a rack-and-pinion mechanism 29. Further, two side fence position sensors 53max and 53min for detecting a detecting piece 41 attached to one rack 28 are provided side by side in the transverse direction of a sheet of delivered transfer paper 11. One side fence position sensor 53max is disposed at a position for detecting the detecting piece 41 at the time that the opposite interval defined between the opposed paper delivery side fences 23 has been brought to the maximum, whereas the other side fence position sensor 53min is disposed at a position for detecting the detecting piece 41 at the time that the interval defined between the opposed paper delivery side fences 23 has been brought to the minimum.

Further, a stepping motor 54 is used as a drive source for a paper delivery end fence 25. A drive shaft 55 of the stepping motor 54 is directly coupled to a pinion gear 36*a* of a rack-and-pinion mechanism 36. Further, two end fence position sensors 56max and 56min for detecting a detecting piece 42 attached to a rack 36*b* of the rack-and-pinion mechanism 36 are provided side by side in the direction in which a sheet of transfer paper 11 is delivered or discharged. One end fence position sensor 56max is provided at a position for detecting the detecting piece 42 at the time that the position of the paper delivery end fence 25 has been brought to one used for the maximum transfer paper, whereas the other end fence position sensor 56min is located in a position for detecting the detecting piece 42 at the time that the position of the paper delivery end fence 25 has been brought to one for the minimum transfer paper.

If the maximum and minimum opposite intervals between the opposed paper delivery side fences 23 and the positions of the paper delivery end fence 25 for the maximum and minimum transfer papers are respectively detected by the two side fence position sensors 53max and 53min and the two end fence position sensors 56max and 56min under such a construction, then the positions of the paper delivery side fences 23 and the position of the paper delivery end fence 25 are recognized from the number of steps corresponding to drive signals of the stepping motors 51 and 54. Accordingly, the interval between the paper delivery side fences 23 and the position of the paper delivery end fence 25 are arbitrarily set based on the number of the steps according to the drive signals of the stepping motors 51 and 54. Since, in this case, the stepping motor 51 is used as the drive source for the paper delivery side fences 23 and the stepping motor 54 is used as the drive source for the paper delivery end fence 25, the reduction mechanism for the drive source becomes unnecessary. Therefore, when the interval between the opposed paper delivery side fences 23 and the position of the paper delivery end fence 25 are manually set, the paper delivery side fence pair 23 and the paper delivery end fence 25 can be displaced by small forces without the need for the electromagnetic clutches 33 and 37 employed in the first embodiment.

When an unillustrated start key on a control panel 18 is depressed after the paper delivery side fences 23 and the paper delivery end fence 25 have been positioned, a printing operation is performed. When a sheet of printed transfer paper 11 is delivered to a paper delivery table 14, the transfer paper 11 is detected by a paper delivery sensor 43. FIG. 12 is a flowchart for explaining the flow of a process at the time that the paper delivery sensor 43 has been turned on. When the paper delivery sensor 43 is turned on, a process; from Steps S22 to S27 and a process from Steps S28 to S33 are parallel-processed by a multitasking function of a controller of a microcomputer configuration and thereby a jogger operation is executed. The jogger operation is performed as follows: As indicated by the flowchart shown in FIG. 12 and a timing chart shown in FIG. 13, the paper delivery sensor 43 is turned on (Step S21) and thereafter the stepping motors 51 and 54 are respectively reversely-driven by times t2 and t7 after the lapse of times t1 and t6 (Steps S22 through S24 and Steps S28 through S30). After times t3 and t8 have been held on (Steps S25 and S31), the stepping motors 51 and 54 are next respectively irreversely-driven by times t4 and t9 (Steps S26 and S27 and Steps S32 and S33). According to such processing, the paper delivery side fence pair 23 and the paper delivery end fence 25 perform the operation of returning their positions to the normal positions after they have firstly expanded slightly. Thus, the sheets of transfer paper 11 delivered to the paper delivery table 14 are controlled and aligned with their normal positions by the paper delivery side fences 23 and the paper delivery end fence 25. After the lapse of a predetermined time (Step S34), the process for reversely driving the stepping motors 51 and 54 is executed again (Step S35). As a result, the paper delivery side fences 23 and the paper delivery end fence 25 are returned to their home positions. Namely, when the printing operation is completed, a resetting means slides the paper delivery side fences 23 until the paper delivery side fences 23 reach their home positions, and slides the paper delivery end fence 25 until a paper length L suitable for the paper delivery table 14 is brought to the maximum. Thus, the paper delivery side fences 23 and the paper delivery end fence 25 are greatly withdrawn so that each transfer paper 11 can be easily taken out of the paper delivery table 14.

A modification of the paper delivery unit 8 employed in the second embodiment will be described. When the interval between the opposed paper delivery side fences 23 and the position of the paper end fence 25 are further fine-adjusted by an operator after the size of the transfer paper 11 has been firstly recognized and the interval defined between the paper delivery side fences 23 and the position of the paper delivery end fence 25 have been automatically set to ones according to the size thereof, the fine-adjusted interval between the opposed paper delivery side fences 23 and the fine-adjusted position of paper delivery end fence 25 can be subjected to memory processing (storing or memory means). Namely, for example, when sheets of transfer paper 11 of special sizes are used and when the type and thickness of each transfer paper 11, and the area, position and the like of an image with respect to the entire transfer paper 11 are special, the paper delivery side fences 23 and the like are subjected to the fine-adjusting process by the operator. However, they will be subjected to increment or decrement processes of the stepping motors 51 and 54 through the control panel 18. Since increment values or decrement values of the stepping motors 51 and 54 are found or revealed from the above-described processing, they are subjected to memory processing. Consequently, the positions of the paper delivery side fences 23 and the like, which correspond to the individual transfer paper 11, are stored as discrete information. The memory values indicative of the individual information are read out from the next time so that the positions of the paper delivery side fence pair 23 and the like can be adjusted. When print image conditions like an image area, an image position and the like can be individually set in this case, the positions of the paper delivery side fence pair 23 and the like, which have met with the conditions, are automatically set and may be subjected to the memory processing. Since the above memory processing effected on the positions of the paper delivery side fence pair 23 and the like corresponds to a process to be executed by the microcomputer, it is easy to use this as a selectively-executed process.

Figure 14:
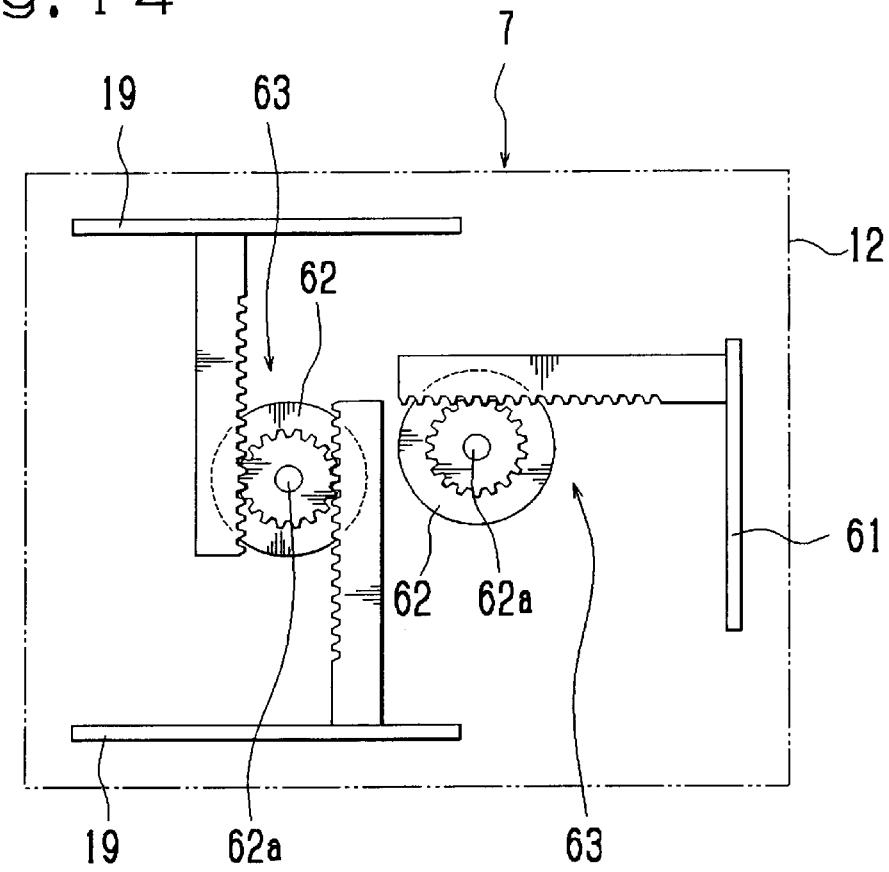
FIG. 14 is a plan view showing the structure of a paper feeding unit employed as a modification of a second embodiment of the present invention.
Figure 15:
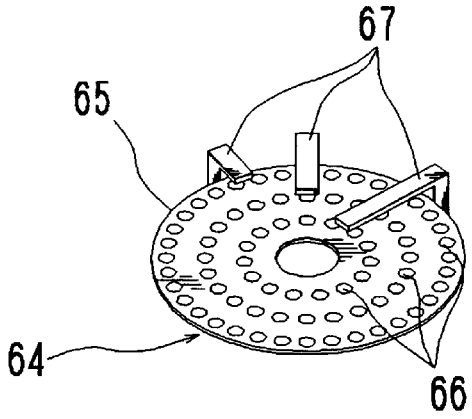
FIG. 15 is a perspective view illustrating an encoder incorporated into a stepping motor used as a drive source for the paper feeding unit shown in FIG. 14.

FIGS. 14 and 15 show a modification of a paper feeding unit 7 employed in the present embodiment. A pair of paper feeding side fences 19 and a paper feeding end fence 61 are constructed so as to integrally slide by a rack-and-pinion mechanism 63 driven by a stepping motor 62. An absolute type encoder 64 (shown in FIG. 15) connected to a control device 16 so as to send data is incorporated into a rotating shaft 62*a* of the stepping motor 62, which is used as rotatable member. The encoder 64 has a structure for detecting three-rows of detecting marks 66 formed on the concentric circle of a disk-shaped detecting plate 65 and different in radius from each other with three sensors 67 to thereby detect an absolute angle of rotation of the stepping motor 62. Accordingly, the absolute positions of the paper feeding side fences 19 and the paper feeding end fence 61 are recognized by the encoder 64 in the control device 16. Owing to the formation of such a structure of the paper feeding unit 7, even when sheets of transfer paper 11 of irregular-format sizes are placed on the paper feeding table 12, the size (width and length) of each transfer paper 11 is recognized by a paper size recognizing means. Since the paper delivery side fences 23 and the paper delivery end fence 25 placed within the paper delivery unit 8 are also driven by the stepping motors 51 and 54 in the present embodiment, the opposite interval between the paper delivery side fences 23 and the position of the paper delivery end fence 25 are also automatically set according to the transfer paper 11 of irregular-format sizes. In this case, it is easy to effect memory processing on the interval between the paper delivery side fences 23 and the position of the paper delivery end fence 25, which have been automatically set in the above-described manner. Thus, the positions of the paper delivery side fences 23 and the paper delivery end fence 25, which have met the transfer paper 11 of above sizes, are stored as memory values. Further, the memory values can be read out from the next time to adjust the positions of the paper delivery side fences 23 and the paper delivery end fence 25.

While the present invention has been described with reference to the illustrative embodiments, this description is not intended to be construed in a limiting sense. Various modifications of the illustrative embodiments, as well as other embodiments of the invention, will be apparent to those skilled in the art on reference to this description. It is therefore contemplated that the appended claims will cover any such modifications or embodiments as fall within the true scope of the invention.

The entire disclosure of Japanese Patent Application No. Hei 8-95192 filed on Apr. 17, 1996 and No. Hei 9-4586 filed on Jan. 14, 1997 including specification, claims, drawings and summary is incorporated herein by reference in its entirety.

What is claimed is:

1. An image forming apparatus for allowing sheets of transfer paper to pass through a paper-passage route extending from a paper feeding unit for accommodating the transfer paper therein to a paper delivery unit for discharging the transfer paper therefrom and forming a desired image on said each transfer paper during the process of said paper passage, comprising:

paper size recognizing means for recognizing the size of the transfer paper delivered to said paper delivery unit;

a pair of paper delivery side fences provided within said paper delivery unit, at least one of which is slidable in the paper-width direction of the transfer paper;

a drive unit for driving said paper delivery side fences which are slidable in the paper-width direction;

setting means for starting up said drive unit so as to set an interval between said paper delivery side fences corresponding to an interval corresponding to the size of the transfer paper, which has been recognized by said paper size recognizing means;

a paper delivery end fence provided within said paper delivery unit and slidable in a paper-delivery forward and reverse direction;

a paper delivery end fence drive unit for driving said paper delivery end fence so as to slide it, setting means for starting up said paper delivery end fence drive unit so as to set the position of said paper delivery end fence to a position corresponding to the result of detection by said paper size recognizing means;

said paper feeding unit having a pair of paper feeding side fences, at least one of which is slidable in a paper-width direction; and resetting means for starting up said drive unit after completion of an image forming operation so as to slide said at least one of said paper delivery side fence pair in the direction in which the interval between the paper delivery side fences is opened up, wherein said paper size recognizing means recognizes the size of transfer paper by detecting an interval between said paper feeding side fences and detecting a transfer paper length.

2. An image forming apparatus as recited in claim 1, wherein said resetting means further starts up said drive unit after completion of image forming operation so as to further slide said paper delivery end fence in the paper-delivery direction.

3. An image forming apparatus for allowing sheets of transfer paper to pass through a paper-passage route extending form a paper feeding unit for accommodating the transfer paper therein to a paper delivery unit for discharging the transfer paper therefrom and forming a desired image on said each transfer paper during the process of said paper passage, comprising:

paper size recognizing means for recognizing the size of the transfer paper delivered to said paper delivery unit;

a pair of paper delivery side fences provided within said paper delivery unit, at least one of which is slidable in the paper-width direction of the transfer paper;

a drive unit for driving said paper delivery side fences which are slidable in the paper-width direction;

setting means for starting up said drive unit so as to set an interval between said paper delivery side fences corresponding to an interval corresponding to the size of the transfer paper, which has been recognized by said paper size recognizing means;

a paper delivery end fence provided within said paper delivery unit and slidable in a paper-delivery forward and reverse direction;

a paper delivery end fence drive unit for driving said paper delivery end fence so as to slide it;

setting means for starting up said paper delivery end fence drive unit so as to set the position of said paper delivery end fence to a position corresponding to the result of detection by said paper size recognizing means;

said paper feeding unit having a pair of paper feeding side fences, at least one of which is slidable in a paper-width direction;

wherein said paper size recognizing means recognizes the size of transfer paper by detecting an interval between said paper feeding side fences and detecting a transfer paper length; and wherein said setting means is activated only when no transfer paper is present in said paper delivery unit.

4. An image forming apparatus for allowing sheets of transfer paper to pass through a paper-passage route extending from a paper feeding unit for accommodating the transfer paper therein to a paper delivery unit for discharging the transfer paper therefrom and forming a desired image on said each transfer paper during the process of said paper passage, comprising:

paper size recognizing means for recognizing the size of the transfer paper delivered to said paper delivery unit;

a pair of paper delivery side fences provided within said paper delivery unit, at least one of which is slidable in the paper-width direction of the transfer paper;

a drive unit for driving said paper delivery side fences which are slidable in the paper-width direction;

setting means for starting up said drive unit so as to set an interval between said paper delivery side fences corresponding to an interval corresponding to the size of the transfer paper, which has been recognized by said paper size recognizing means;

a paper delivery end fence provided within said paper delivery unit and slidable in a paper-delivery forward and reverse direction;

a paper delivery end fence drive unit for driving said paper delivery end fence so as to slide it;

setting means for starting up said paper delivery end fence drive unit so as to set the position of said paper delivery end fence to a position corresponding to the result of detection by said paper size recognizing means;

said paper feeding unit having a pair of paper feeding side fences, at least one of which is slidable in a paper-width direction;

wherein said paper size recognizing means recognizes the size of transfer paper by detecting an interval between said paper feeding side fences and detecting a transfer paper length, and wherein:

a motor is used as said drive unit;

a clutch is configured to engage with said motor; and said clutch is engaged with said motor only when a driven unit is driven by said motor.

* * * * *

UNITED STATES PATENT AND TRADEMARK OFFICE

CERTIFICATE OF CORRECTION

PATENT NO. : 6,073,925

DATED : June 13, 2000

INVENTOR(S): Mitsuo Sato

It is certified that an error appears in the above-identified patent and that said Letters Patent is hereby corrected as shown below:

In column 5, line 51, change "the n" to --then--.
In column 10, line 63, change "o,n" to --on--.
In column 11, line 53, change "e:ad" to --end--.
In column 12, line 40, change "invention" to --invention.--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*